US007645158B2

(12) United States Patent
Mulhouse et al.

(10) Patent No.: US 7,645,158 B2
(45) Date of Patent: Jan. 12, 2010

(54) TERMINAL BLOCK AND TEST PAD FOR AN HVAC CONTROLLER

(75) Inventors: David P. Mulhouse, Minnetonka, MN (US); Ludek Zavodny, Brno (CZ)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/966,931

(22) Filed: Dec. 28, 2007

(65) Prior Publication Data

US 2008/0160799 A1 Jul. 3, 2008

Related U.S. Application Data

(63) Continuation-in-part of application No. 11/618,378, filed on Dec. 29, 2006.

(51) Int. Cl.
*H01R 11/20* (2006.01)

(52) U.S. Cl. ..... 439/441; 439/912; 165/11.1; 324/538

(58) Field of Classification Search ..... 439/709, 439/620.22, 668, 716, 76.1, 78, 441, 912; 324/538; 165/11.1
See application file for complete search history.

(56) References Cited

U.S. PATENT DOCUMENTS 2,958,065 A * 10/1960 Flanagan, Jr. ..... 439/381
3,147,054 A * 9/1964 Alexander et al. ..... 439/67
5,059,897 A 10/1991 Aton et al.
5,320,558 A 6/1994 Von Roretz
5,484,306 A 1/1996 Mawby et al.
5,495,887 A * 3/1996 Kathnelson et al. ..... 165/11.1
5,506,499 A 4/1996 Puar
5,637,835 A 6/1997 Matern
5,680,056 A 10/1997 Ito et al.
5,978,093 A 11/1999 Abrahamson
6,012,944 A 1/2000 Hatakeyama
6,056,585 A 5/2000 Hatakeyama et al.
6,074,241 A 6/2000 Patel et al.
6,146,187 A 11/2000 Pallai
6,210,208 B1 4/2001 Barnes et al.
6,250,950 B1 6/2001 Pallai
6,369,407 B1 4/2002 Hikita et al.
6,832,938 B2 * 12/2004 Lenker ..... 439/835
6,833,727 B2 12/2004 Farnworth et al.
7,238,043 B2 7/2007 Reibke et al.
7,249,963 B2 7/2007 Ramm
7,297,019 B2 11/2007 Landis et al.
7,345,366 B2 3/2008 Jow et al.
2007/0099480 A1 5/2007 Fabian et al.
2008/0023832 A1 1/2008 Chang
2008/0074137 A1 3/2008 Kim et al.

OTHER PUBLICATIONS

EBY Electro, Inc., EB3516 5.0mm Spacing, Screwless, Dual Wire Entry, 1 page, 2003.

* cited by examiner

*Primary Examiner*—Edwin A. Leon
*Assistant Examiner*—Vanessa Girardi

(57) ABSTRACT

An electrical terminal assembly for an HVAC device is disclosed. In one illustrative embodiment, the terminal assembly includes one or more quick-connect or screwless type terminal blocks mounted on a printed circuit board. The terminal assembly may also include one or more test pads electrically connected to the one or more quick-connect or screwless terminals via one or more traces on the printed circuit board. The one or more test pads may include a recessed portion.

20 Claims, 4 Drawing Sheets

TERMINAL BLOCK AND TEST PAD FOR AN HVAC CONTROLLER

PRIORITY CLAIM

This application is a continuation-in-part of U.S. application Ser. No. 11/618,378, filed Dec. 29, 2006.

FIELD

The present invention relates generally to heating, ventilation, and air conditioning (HVAC) systems, and more particularly, to electrical terminals for HVAC controllers and other devices.

BACKGROUND

Heating, ventilation, and/or air conditioning (HVAC) systems are often used to control the comfort level within a building or other structure. In many HVAC systems, one or more HVAC controllers may be configured to activate and deactivate one or more HVAC components of the HVAC system to affect and control one or more environmental conditions within the building. These environmental conditions can include, but are not limited to, temperature, humidity, and/or ventilation. In many cases, the controller of the HVAC controller may include, or have access to, one or more sensors, and may use sensed parameters provided by the one or more sensors to control the one or more HVAC components to achieve one or more programmed or set environmental conditions.

In many installations, the HVAC system can include a plurality of wires running through the building or other structure to provide a communication path between the one or more HVAC controllers, one or more HVAC components, sensors, and/or any other HVAC device. At least some of the one or more HVAC controllers, one or more HVAC components, sensors, and/or other HVAC devices may include a terminal block configured to receive an end of one of the plurality of wires. Traditionally, these terminal blocks have been screw-type terminal blocks. However, more recently, quick-connect or screwless terminal blocks have been used instead of the screw-type terminal blocks due to a number of advantages. However, with the traditional screw terminal blocks, the screw head provided an easy electrical testing location. With quick-connect or screwless terminal blocks, there is no easily accessible site to electrically test the terminal. Therefore, there is a need for a terminal having the advantages of the quick-connect or screwless terminal blocks that has an easily accessible electrical testing area.

SUMMARY

The following summary is provided to facilitate an understanding of some of the innovative features unique to the present invention and is not intended to be a full description. A full appreciation of the invention can be gained by taking the entire specification, claims, drawings, and abstract as a whole.

The present invention relates generally to HVAC systems, and more particularly, to electrical terminals for HVAC controllers and other devices. In one illustrative embodiment, an electrical terminal assembly for a HVAC controller is disclosed. The illustrative terminal assembly may include one or more quick-connect or screwless terminal blocks mounted on a printed circuit board. The terminal assembly may include one or more test pads electrically connected to the one or more quick-connect or screwless terminal blocks. The one or more test pads may include a recessed portion.

BRIEF DESCRIPTION

The invention may be more completely understood in consideration of the following detailed description of various illustrative embodiments of the invention in connection with the accompanying drawings, in which.

DETAILED DESCRIPTION

Figure 1:
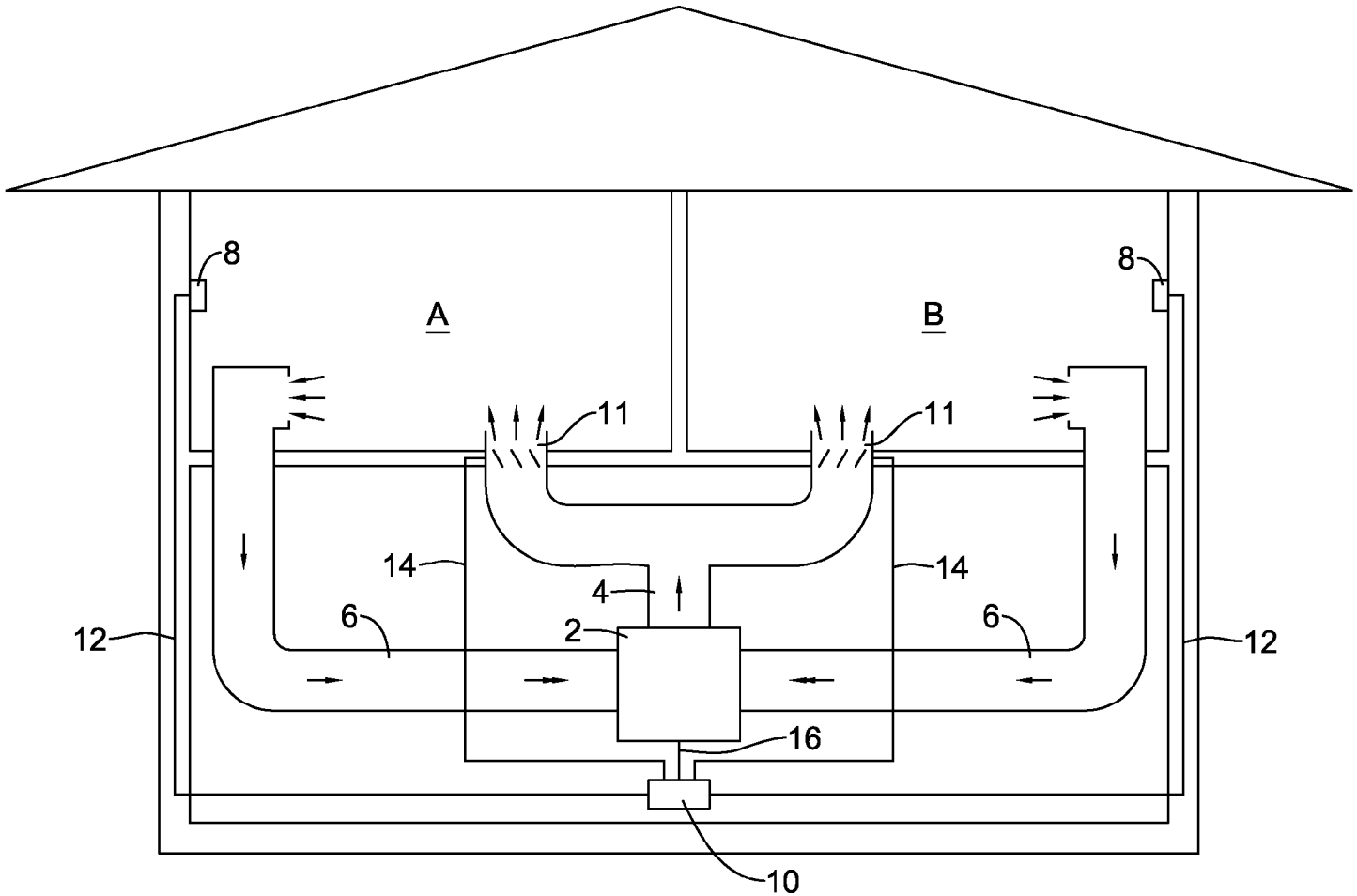
FIG. 1 is a schematic view of a building or other structure having an illustrative zoned heating, ventilation, and air conditioning (HVAC) system.

The following description should be read with reference to the drawings wherein like reference numerals indicate like elements throughout the several views. The detailed description and drawings show several embodiments which are meant to be illustrative of the claimed invention.

FIG. 1 is a schematic view of a building or other structure having an illustrative zoned heating, ventilation, and air conditioning (HVAC) system. While FIG. 1 shows a typical force air type HVAC system, other types of HVAC systems may be used including hydronic systems, boiler systems, radiant heating systems, electric heating systems, or any other suitable type of HVAC system, as desired. Additionally, while FIG. 1 shows a zoned HVAC system, it is contemplated that a non-zoned HVAC system may be used, as desired.

As illustrated, the zoned HVAC system of FIG. 1 includes one or more HVAC components 2, a system of vents or ductwork 4 and 6, one or more HVAC controllers 8, and one or more HVAC zone controller 10. The one or more HVAC components 2 may include, but are not limited to, a furnace, a boiler, a heat pump, an electric heating unit, an air conditioning unit, a humidifier, a dehumidifier, an air exchanger, an air cleaner, and/or the like.

In the illustrative HVAC system shown in FIG. 1, the one or more HVAC components 2 can provide heated air (and/or cooled air) via the ductwork throughout the building or other structure. As illustrated, the one or more HVAC components 2 may be in fluid communication with every room and/or zone in the building or other structure via the ductwork 4 and 6. In operation, when a heat call signal is provided by one or more of the HVAC controllers 8 or HVAC zone controller 10, one or more HVAC components 2 (e.g. forced warm air furnace) may be activated to supply heated air to one or more rooms and/or zones within the building or other structure via supply air ducts 4. The heated air may be forced through supply air duct 4 by a blower or fan. In this example, the cooler air from each zone may be returned to the one or more HVAC components 2 (e.g. forced warm air furnace) for heating via return air ducts 6. Similarly, when a cool call signal is provided by one or more of the HVAC controllers 8 or HVAC zone controller 10, the one or more HVAC components 2 (e.g. air conditioning unit) may be activated to supply cooled air to one or more rooms and/or zones within the building or other structure via supply air ducts 4. The cooled air may be forced through supply air duct 4 by the blower or fan. In this example, the warmer air from each zone may be returned to the one or more HVAC components 2 (e.g. air conditioning unit) for cooling via return air ducts 6.

In some cases, the system of vents or ductwork 4 and 6 can include one or more dampers 11 to regulate the flow of air. For example, one or more dampers 11 may be coupled to the HVAC zone controller 10 and can be coordinated with the operation of one or more HVAC components 2. The HVAC zone controller 10 may actuate dampers 11 to an open position, a closed position, and/or a partially open position to modulate the flow of air from the one or more HVAC components 2 to an appropriate room and/or zone in the building or other structure. The dampers 11 may be particularly useful in zoned HVAC systems, and may be used to control which zone(s) receives conditioned air from the HVAC components 2. For example, if zone A requires heating and zone B does not, the HVAC zone controller 10 may activate one or more HVAC components 2 (e.g. forced warm air furnace) and may actuate the dampers 9 to allow air flow through ductwork 4 into zone A while restricting air flow into zone B. Similarly, if zone B requires heating and zone A does not, the HVAC zone controller 10 may activate one or more HVAC components 2 (e.g. forced warm air furnace) and may actuate the dampers 9 to allow air flow through ductwork 4 into zone B while restricting air flow into zone A.

It is contemplated that the one or more HVAC controllers 8 may be configured to control the comfort level of at least a portion of the building or structure by activating and deactivating the one or more HVAC components 2. In some cases, the one or more HVAC controllers 8 may be thermostats, such as, for example, wall mountable thermostat, but this is not required in all embodiments. In the illustrative embodiment, the HVAC controllers 8 may each control the comfort level within a particular zone, such as zone A or B, in the building or other structure.

In the illustrative embodiment, the HVAC controller 8 may be operatively coupled to the HVAC zone controller 10. HVAC zone controller 10 may be configured to receive signal calls from the one or more HVAC controllers 8 and, in response, activate and deactivate the one or more HVAC components 2 and to modulate the air flow through the system of ductwork 4 and 6 by actuating dampers 9. As illustrated, the one or more HVAC controllers 8 may be connected to the HVAC zone controller 10 via one or more wires 12. The HVAC zone controller 10 may be connected to the one or more building components 2 via wire 16 and to the dampers 9 via wires 14.

In the illustrative embodiment, the one or more HVAC controllers 8 and/or the HVAC zone controller 10 may include one or more terminal blocks configured to receive one end of the one or more wires 12, 14, and/or 16. In some cases, the one or more terminal blocks may be quick-connect terminal blocks, as will be discussed with reference to FIGS. 2 and 3. However, it is contemplated that any suitable terminal block may be used, as desired. Additionally, it is contemplated that one or more HVAC components 2 or other devices may include terminal blocks, as desired.

In the illustrative embodiment, the one or more HVAC controllers 8 and/or the HVAC zone controller 10 may include a control module and/or one or more sensors. In some cases, the one or more temperature sensor 18 may include a temperature sensor, a humidity sensor, a ventilation sensor, an air quality sensor, and/or any other suitable HVAC building control system sensor, as desired. Control module may be configured to help control the comfort level (i.e. heating, cooling, ventilation, air quality, etc.) of at least a portion of the building or structure by controlling whether one or more HVAC components 2 of HVAC equipment are activated. In some instances, the control module may include a processor and a memory, but this is not required. Control module may be configured to control and/or set one or more HVAC functions, such as, for example, HVAC schedules, temperature setpoints, humidity setpoints, trend logs, timers, environment sensing, and/or other HVAC functions or programs, as desired.

Furthermore, it is contemplated that the illustrative HVAC controllers 8 and HVAC zone controller 10 may be any suitable controller, as desired. In some cases, the HVAC controllers 8 and/or the HVAC zone controller 10 may include a wireless interface and/or user interface. The wireless interface may be configured to wirelessly communicate (i.e. transmit and/or receive signals) with one or more HVAC controllers, HVAC components, or HVAC devices to send and/or receive HVAC signals. It is contemplated that the wireless interface may include, for example, a radio frequency (RF) wireless interface, an infrared wireless interface, a microwave wireless interface, an optical interface, and/or any other suitable wireless interface, as desired. The user interface may be any suitable interface that is configured to display and/or solicit information as well as permit a user to enter data and/or other settings, as desired. In some cases, user interface may allow a user or technician to program and/or modify one or more control parameters of HVAC system, such as programming, set point, time, equipment status and/or parameters, as desired. In some instances, the user interface may include a touch screen, a liquid crystal display (LCD) panel and keypad, a dot matrix display, a computer, buttons and/or any other suitable interface, as desired.

Figure 2:
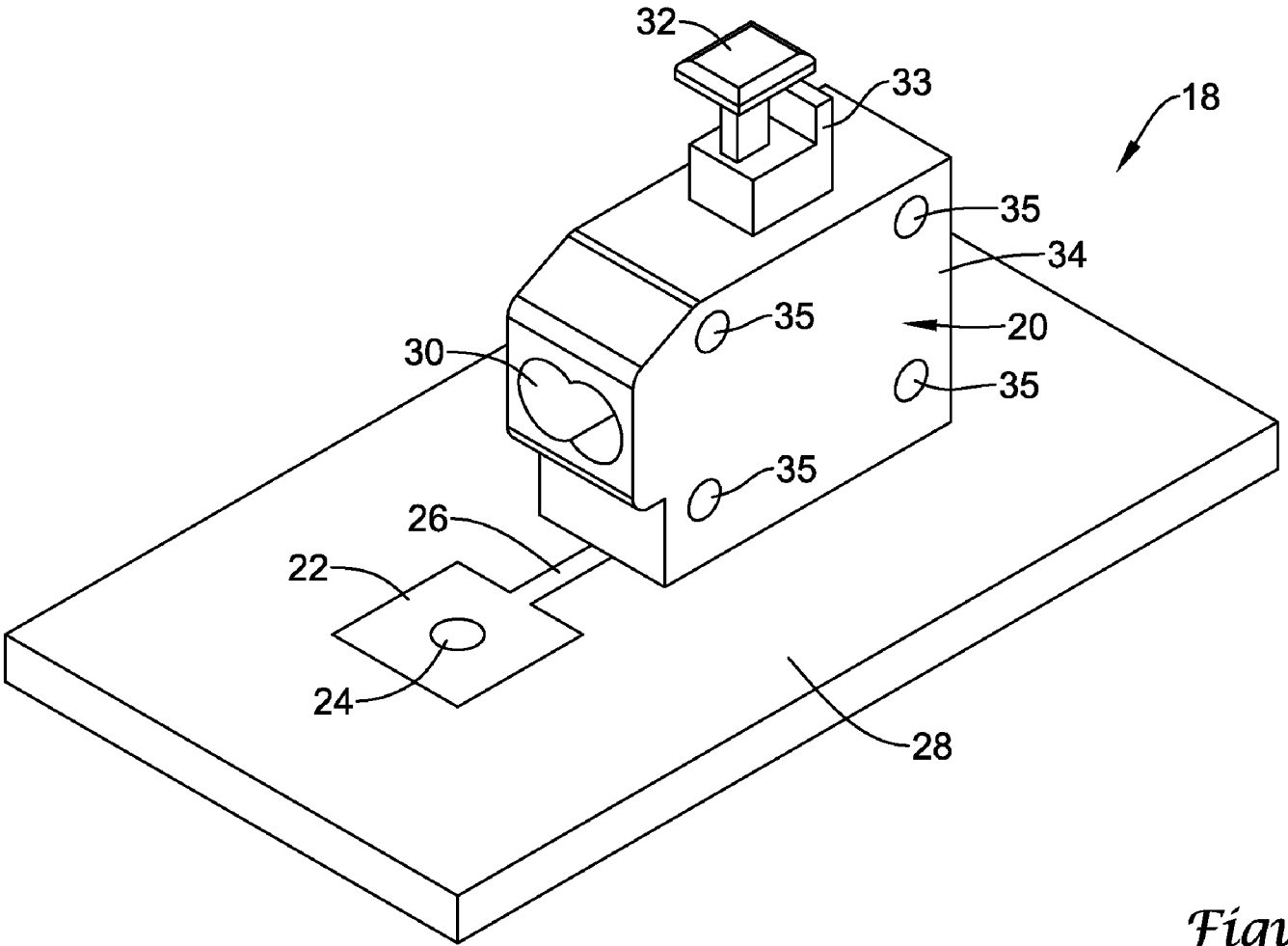
FIG. 2 is a perspective view of an illustrative terminal assembly.

FIG. 2 is a perspective view of an illustrative terminal assembly 18 in accordance with the present invention. In the illustrative embodiment, the terminal assembly 18 may be provided in one or more HVAC controllers 8, the HVAC zone controller 10, HVAC components 2, HVAC sensors and other devices shown and described with reference to FIG. 1, and more generally, in any suitable controller or device, as desired.

In the illustrative embodiment, the terminal assembly 18 may include a terminal block 20 and a test pad 22 mounted on or disposed on a printed circuit board (PCB) 28. The illustrative PCB 28 may include a non-conductive substrate providing mechanical support for one or more electrical components and may include one or more conductive pathways or traces 26 to electrically connect one or more electrical components. In some cases, the PCB 28 may include a number of layers or sheets forming the substrate. The traces 26 may be provided on an outer layer of the PCB 28 or an intermediate layer of the PCB 28, as desired. In some cases, the PCB 28 may also be referred to as a printed wiring board (PWB), a printed circuit assembly (PCA), or a printed circuit board assembly (PCBA). In some cases, the PCB 28 may be plated with gold, silver, or any other suitable plating material, but this is not required. In some cases, the plating material may help increase the electrical connection between the terminal block 20 and PCB 28. For example, in one case, the plating may help to reduce oxidation on the PCB 28.

In the illustrative embodiment, terminal block 20 may be configured to receive at least a portion of a wire (shown as 42 in FIG. 3), such as a first end of a wire, to electrically connect the wire to one or more electrical components on the PCB 28. In some cases, a second end of the wire may be electrically connected to one or more HVAC controllers, one or more HVAC components, or other HVAC devices, as desired.

In some cases, the terminal block 20 may be a quick-connect or screwless terminal block. In one example, the quick-connect or screwless terminal block may be a screwless terminal block available from EBY Electro, Inc. © of Plainview N.Y., such as, for example, part number EB3516. In the illustrative embodiment, the terminal block 20 may include a housing 34 to encase the electrical components of the terminal block 20. In some cases, the housing 34 may be a relatively non-conductive material, such as, for example, a polymer or polyamide. However, any suitable non-conductive material may be used, as desired.

As illustrated, the housing 34 may include an opening 30 sized and configured to receive the end of a wire. As illustrated, the opening 30 may be positioned on a side of the housing. However, it is contemplated that the opening 30 may be provided in any location on the housing 34, as desired. Housing 34 may also include one or more connector holes 35, but this is not required. Connector holes 35 may be configured to receive a connector, such as, for example a screw or rod, to help connect two or more terminal housings 34 together. In this case, a plurality of terminal blocks 20 may be provided in the terminal assembly 18. In another example, housing 34 may be configured to include a plurality of terminal blocks 20. For example, housing 34 may include two terminal blocks, three terminal blocks, five terminal blocks, or any number of terminal blocks as desired. In this case, the housing 34 may be a housing block that corresponds to a plurality of terminal blocks 20. Alternatively, or in addition, a terminal block 18 may be provided that has a housing 34 (and associated internal components) to accommodate two or more openings 30 for receiving and connecting to two or more wires 44 to a PCB 28.

In the illustrative embodiment of FIG. 2, terminal block 20 includes a release button 32 provided in a protruding portion 33 of the housing 34. The release button 32 may be configured to release the wire from the opening 30 of the terminal block 20 when the release button 32 is depressed.

The terminal block 20 may be electrically connected to at least a portion of the PCB 28. In one example, the terminal block 20 may include one or more electrically conductive contacts (shown as 38 in FIG. 3) that may engage at least a portion of the PCB 28. In one case, the contact(s) 38 may include a conductive material, such as, for example, copper or brass. In some cases, the conductive material may be plated, such as, for example, with tin. However, it is contemplated that any suitable conductive material may be used, as desired.

In some cases, the one or more contacts 38 of the terminal block 20 may contact one or more traces 26 of the PCB 28. In some cases, the one or more traces 26 may be electrically connected to one or more electrical components and/or electrically connected to the test pad 22. In some instances, the contacts 38 of the terminal block 20 may contact only one trace 26, and the one trace 26 is electrically connected to only one test pad 22, and no other electrical components on the PCB. Test pad 22 may be an area that a user, installer, or technician may probe to test the electrical characteristics at the terminal block 20, and thus any connected wire 44.

In the illustrative embodiment, test pad 22 may be provided on the PCB 28 adjacent to the terminal block 20. As illustrated, test pad 22 may be electrically connected to the terminal block 20 via one or more traces 26. In some cases, and as illustrated, the traces 26 may be provided on an upper surface or layer of the PCB 28, but this is not required. In other cases, the traces 26 may be provided in an intermediate layer of the PCB 28 or on a bottom surface or layer of the PCB 28, as desired. Furthermore, it is contemplated that the test pad 22 may be provided in any suitable location on the PCB 28 so long as the test pad 22 is electrically connected to terminal 20 and accessible by a user, installer or technician. As illustrated, the test pad 22 may be generally rectangular in shape. However, this is not meant to be limiting in any manner. It is contemplated that any suitable shape may be used for the test pad 22, as desired.

In some cases, the test pad 22 may include a recessed portion 24. In one case, the recessed portion may be a hole or recess drilled or otherwise formed into a portion of the test pad 22. In some cases, the hole or recess 24 may be generally centered on the test pad 22, but this is not required. Also, it is contemplated that more than one hole or recess may be provided in the test pad 22. In some cases, the hole(s) or recess (es) 24 may extend through the test pad or, in other cases, only into a portion of the test pad 22, as desired. In other cases, test pad 22 may have an undulating surface, one or more raised portions, or one or more recessed portions, as desired. In the illustrative embodiment, the test pad 22 may include a conductive material, such as, for example, copper or brass. However, it is contemplated that any suitable conductive material may be used for the test pad 22, as desired.

Figure 3:
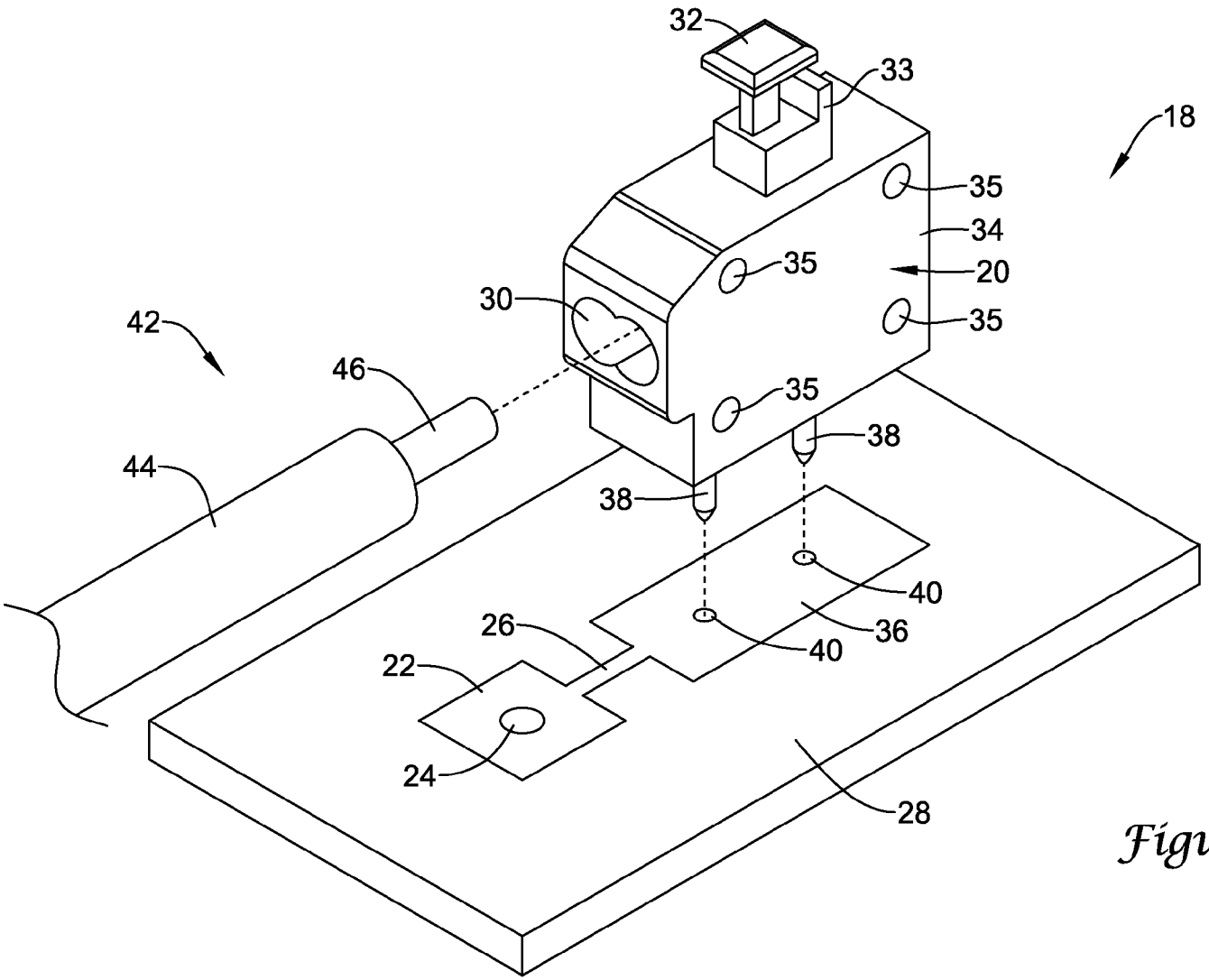
FIG. 3 is an exploded view of the illustrative terminal assembly of FIG. 2.

FIG. 3 is an exploded view of the illustrative terminal assembly 18 of FIG. 2. As illustrated, the PCB 28 may include a terminal block mounting area 36 and one or more holes 40. As illustrated, the terminal block mounting area 36 may include a conductive material that may be electrically connected to trace 26. In other cases, the terminal block mounting area may be relatively non-conductive, as desired. The one or more holes 40 may be configured to receive the one or more contacts 38 of the terminal block 20. At least one of the holes 40 may be electrically connected to the test pad 22 via trace 26.

As illustrated, terminal block 20 may include one or more contacts 38 to electrically and physically connect the terminal block 20 to the PCB 28. As illustrated, terminal block 20 may include two contacts 38. However, it is contemplated that the terminal block 20 may include any suitable number of contacts 38, including one contact 38, if desired.

During assembly, the PCB 28 may be processed to include test pad 22 and trace 26. The PCB 28 may also be processed to include holes 40 and a desired terminal mounting area 36, if desired. Then, once the PCB 28 is processed, the terminal block 20 contacts 38 may be aligned with holes 40 and mounted on the terminal mounting area 36 of the PCB 28. Test pad 22 recessed portion 24 or hole may be provided in the test pad 22 during the processing of the PCB 28 (i.e. prior to mounting the terminal) or after the mounting of the terminal 20 on the PCB 28, as desired.

In the illustrative embodiment, the terminal block 20 may be attached to or secured to the PCB 28 during the mounting process. In one case, the terminal block 20 may be soldered onto the PCB 28 with solder during the mounting process. In some cases, the solder may help provide an increased electrical and/or mechanical connection between the terminal block 20 and the PCB 28, but this is not required. However, it is contemplated that any suitable method of attachment may be used to attach the terminal block 20 to the PCB 28, as desired. For example, it is contemplated that the terminal block 20 may be a surface mount terminal block. In one example, the contact(s) 38 may take the form of feet that do not extend through holes in the PCB 28, but rather are configured to be soldered directly to a solder pad on the PCB 28 using a Surface Mount Technology (SMT). The solder pad on the PCB 28 is then electrically connected to the test pad 22.

In the illustrative embodiment of FIGS. 2-3, the terminal block 20 of the terminal assembly 18 may be configured to receive a wire 42 in the opening 30 of the terminal block 20. As illustrated, the wire 42 may include a conductive core 46 and an outer insulating layer 44. To connect the wire 42 to terminal block 20, a portion of the outer layer 44 may be stripped from the end of the wire 42, exposing the inner conductive core 46. The inner conductive core 46 may then be inserted into the opening 30 of the terminal block 20. In one example, when the terminal block 20 is a screwless terminal, the terminal block 20 may be configured to receive and accept the wire 42 when the wire 42 is pushed into the terminal opening 30. To release the wire 42 from the terminal opening 30, release button 32 may be depressed and held while the wire 42 is pulled from the terminal opening 30. However, it is contemplated that release button 32 may need to be depressed to accept the wire into terminal opening 30, depending on the type of quick-connect terminal used.

Figure 4:
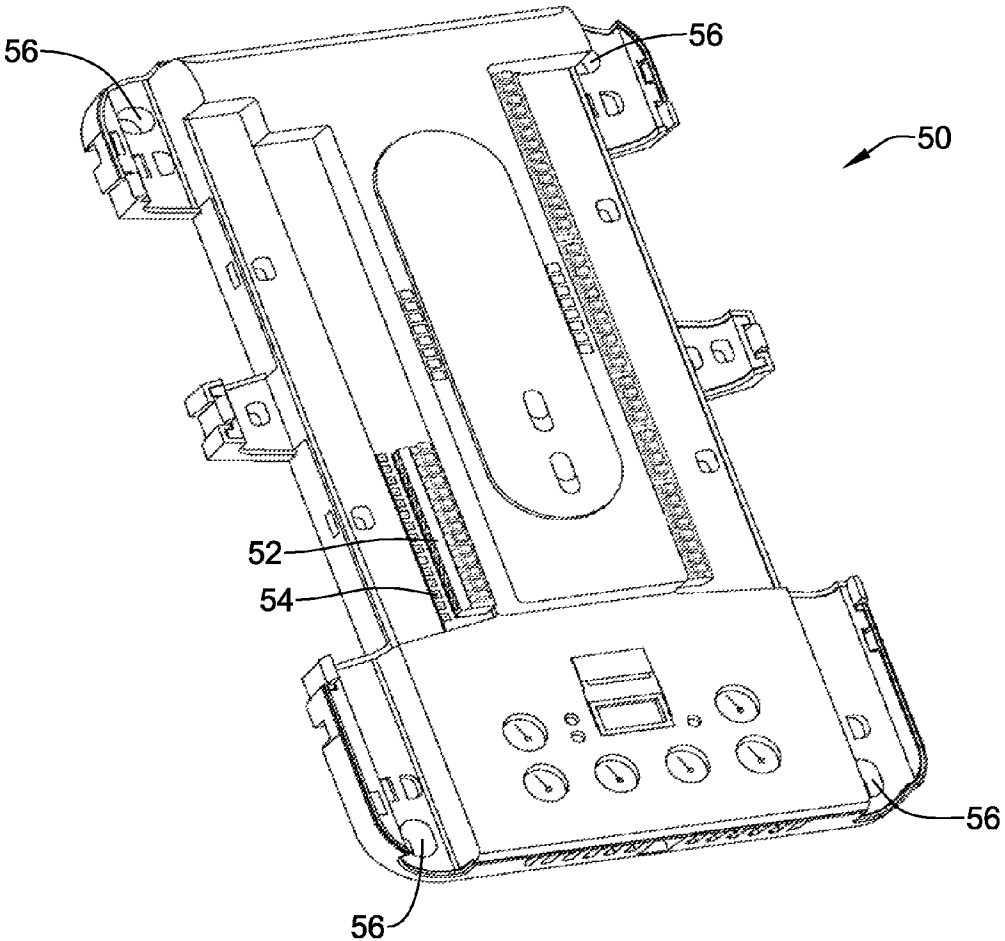
FIG. 4 is a perspective view of at least a portion of an illustrative HVAC controller including the illustrative terminal assembly of FIGS. 2 and 3.

FIG. 4 is a perspective view of at least a portion of an illustrative HVAC controller including the illustrative terminals 52 and test pads 54. In the illustrative embodiment, the HVAC controller may be a HVAC zone controller and may be configured to be connected to one or more thermostats, one or more HVAC components, one or more HVAC sensors, and/or other HVAC devices or components as desired via terminal blocks 52. While an HVAC zone controller is shown in FIG. 4, it is contemplated that any suitable HVAC device may be used, as desired.

In the illustrative embodiment, a controller 50 is shown. In some cases, the controller 50 may be a zone controller or a wall plate of a controller, as desired. In the illustrative case, the controller 50 may include one or more mounting holes 56 configured to receive a fastener, such as, for example a screw, to secure the controller 50 to a wall of a building or other structure. As illustrated, the controller 50 includes six mounting holes 56. However, it is contemplated that any suitable number of mounting holes 56 may be used, as desired.

As illustrated, the controller 50 may include a plurality of terminal blocks 52. The illustrative terminal blocks 52 may be electrically connected to the electrical components mounted or otherwise attached to the controller 50, as desired. In some cases, one or more traces (not shown) may be used to provide the electrical connection, if desired.

In the illustrative embodiment, the terminal blocks 52 may be provided as blocks, where a terminal housing includes a plurality of terminal blocks 52, but this is not required. Similar to that discussed previously, the terminal blocks 52 may include an opening configured to receive an end of a wire. Each terminal block 52 may also include a button release to release a wire from the terminal block 52. However, terminal block 52 is merely illustrative and it is contemplated that any suitable quick-connect or screwless terminal block may be used, as desired.

Similar to that discussed above, test pads 54 are provided adjacent to and electrically connected to corresponding terminal blocks 52. As illustrated, test pads 54 are provided adjacent to the opening of the corresponding terminal blocks 52, but this is not required. As discussed previously and as illustrated, test pads 54 may include a recessed portion or hole, which may help a user, installer or technician hold a probe on the test pads 54, but this is not required.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respect, only illustrative. Changes may be made in details, particularly in matters of shape, size, and arrangement of parts without exceeding the scope of the invention. The invention's scope is, of course, defined in the language in which the appended claims are expressed.

The invention claimed is:

1. An HVAC controller comprising:

a housing, the housing configured to be mountable to a wall;

a printed circuit board having one or more components that are configured to control one or more HVAC components of an HVAC system;

a terminal block mounted to the printed circuit board, wherein the terminal block is configured to receive at least a portion of a wire and to electrically connect the wire to a printed circuit board trace on the printed circuit board;

a test pad part of the printed circuit board, wherein the test pad is spaced from but located adjacent to the terminal block and electrically connected to the terminal block via a printed circuit board trace on the printed circuit board; and the housing further configured to enclose and protect at least part of the printed circuit board, while at the same time exposing the terminal block and the test pad for ready access by a user, such that a user can readily connect a portion of a wire from an HVAC system to the terminal block and can readily access and hold a probe on the test pad.

2. The HVAC controller of claim 1, wherein the terminal block is a quick-connect or screwless terminal block.

3. The HVAC controller of claim 2, wherein the terminal block includes an opening configured to receive an end of the wire.

4. The HVAC controller of claim 2, wherein the terminal block includes a terminal block housing, wherein the terminal block housing is non-conductive.

5. The HVAC controller of claim 2, wherein the terminal block is part of a terminal block assembly that includes a plurality of terminal blocks.

6. The HVAC controller of claim 1, wherein the test pad includes a recess to help a user hold the probe on the test pad.

7. The HVAC controller of claim 1, wherein the test pad includes an electrically conductive material.

8. The HVAC controller of claim 7, wherein the test pad includes copper.

9. An HVAC controller for controlling at least part of an HVAC system, comprising:

a housing;

a printed circuit board;

a plurality of terminal blocks mounted to the printed circuit board;

a plurality of test pads provided on and being part of the printed circuit board each test pad spaced from but located adjacent to a corresponding one of the terminal blocks and each test pad being electrically connected to the corresponding terminal block via a printed circuit board trace on the printed circuit board; and the housing configured to enclose and protect at least part of the printed circuit board, while at the same time exposing the plurality of terminal blocks and the plurality of test pads such that they are individually and readily accessible by a user.

10. The HVAC controller of claim 9, wherein the printed circuit board traces extends directly from a test pad to the corresponding terminal block along a straight line.

11. The HVAC controller of claim 9, wherein at least some of the test pads include a flat conductive pad with a recess within the perimeter of the test pad.

12. The HVAC controller of claim 9, wherein the terminal blocks include an opening configured to receive an end of a wire.

13. The HVAC controller of claim 9, wherein the HVAC controller is a wall mountable thermostat, wherein the housing includes one or more features for mounting the housing to a wall, and wherein the printed circuit board includes one or more components that are configured to control one or more HVAC components of an HVAC system based on a sensed temperature.

14. The HVAC controller of claim 9 wherein the HVAC controller is a zone controller, wherein the housing includes one or more features for mounting the housing to a wall, and wherein the printed circuit board includes one or more components that are configured to control one or more HVAC components of a zoned HVAC system.

15. The HVAC component of claim 9 wherein the HVAC component includes a sensor.

16. An HVAC controller comprising:

a housing, the housing configured to be mountable to a wall;

a plurality of quick-connect terminals mounted to a printed circuit board;

a plurality of test pads printed on the printed circuit board, each of the plurality of test pads spaced from but located adjacent to a corresponding one of the plurality of quick-connect terminals and electrically connected to the corresponding one of the plurality of quick-connect terminals; and wherein the housing is configured to enclose and protect at least part of the printed circuit board, and also includes one or more openings to expose the plurality of quick-connect terminals and the plurality of test pads for ready access by a user such that a user can readily connect a portion of a corresponding wire to each of the quick-connect terminals and can also readily access and hold a probe on each of the plurality of test pads.

17. The HVAC controller of claim 16 wherein at least some of the plurality of test pads include a flat conductive pad with a recess within the perimeter of the test pad.

18. The HVAC controller of claim 16 wherein the plurality of test pads include copper.

19. The HVAC controller of claim 16 wherein the HVAC controller is a zone controller, and the printed circuit board includes one or more components that are configured to control one or more HVAC components of a zoned HVAC system.

20. The HVAC controller of claim 16 wherein the HVAC controller is a wall mountable thermostat, and the printed circuit board includes one or more components that are configured to control one or more HVAC components of an HVAC system based on a sensed temperature.

* * * * *